US012716121B2

(12) United States Patent
Guiglionda et al.

(10) Patent No.: US 12,716,121 B2
(45) Date of Patent: Aug. 25, 2026

(54) STRIP MADE OF 6XXX ALLOY AND MANUFACTURING PROCESS

(71) Applicants: CONSTELLIUM MUSCLE SHOALS LLC, Muscle Shoals, AL (US); CONSTELLIUM NEUF-BRISACH, Biesheim (FR)

(72) Inventors: Gilles Guiglionda, Seyssinet-Pariset (FR); Michael Langille, Fontaine (FR); Jichao Li, Plymouth, MI (US)

(73) Assignees: CONSTELLIUM MUSCLE SOALS LLC, Muscle Shoals, AL (US); CONSTELLIUM NEUF-BRISACH, Biesheim (FR)

( * ) Notice: Subject to any disclaimer, the term of this patent is extended or adjusted under 35 U.S.C. 154(b) by 3 days.

(21) Appl. No.: 18/712,904

(22) PCT Filed: Nov. 23, 2022

(86) PCT No.: PCT/FR2022/052168
§ 371 (c)(1),
(2) Date: May 23, 2024

(87) PCT Pub. No.: WO2023/094773
PCT Pub. Date: Jun. 1, 2023

(65) Prior Publication Data

US 2024/0417839 A1 Dec. 19, 2024

(30) Foreign Application Priority Data

Nov. 25, 2021 (FR) ..... 2112544

(51) Int. Cl.
*B32B 15/01* (2006.01)
*B22D 11/00* (2006.01)
(Continued)

(52) U.S. Cl.
CPC ..... *C22F 1/043* (2013.01); *B22D 11/003* (2013.01); *B22D 11/041* (2013.01); *C22C 21/02* (2013.01); *C22F 1/002* (2013.01)

(58) Field of Classification Search
None
See application file for complete search history.

(56) References Cited

U.S. PATENT DOCUMENTS 5,582,660 A * 12/1996 Erickson ..... C22C 21/02 148/552
2002/0005232 A1 1/2002 Matsuda et al.
(Continued)

FOREIGN PATENT DOCUMENTS

EP 3227036 A1 10/2017
JP 2010156024 A 7/2010
(Continued)

OTHER PUBLICATIONS

International Search Report (English translation included) and Written Opinion for International Application No. PCT/FR2022/052168, issued Feb. 16, 2023, 11 pages.

*Primary Examiner* — Daniel J. Schleis
(74) *Attorney, Agent, or Firm* — McBee Moore & Vanik IP, LLC

(57) ABSTRACT

The invention is an aluminum alloy strip having the composition Si: 1.00-1.50% %, Fe: <=0.30%, Mn: <=0.30%, Mg: 0.20%-0.44%, Cu: 0.80%-1.50%, Ti: 0.03%-0.15%, Cr: <=0.10%, Zn: <–0.10%. This strip has formability properties equivalent to that of an AA5182 alloy strip in state 0. This invention further relates to the production of motor vehicle doors, the inner panel of which is made with the strip according to the invention.

16 Claims, 4 Drawing Sheets

(51) Int. Cl.

| | |
|---|---|
| ***B22D 11/041*** | (2006.01) |
| ***C22C 21/02*** | (2006.01) |
| ***C22F 1/00*** | (2006.01) |
| ***C22F 1/043*** | (2006.01) |

(56) References Cited

U.S. PATENT DOCUMENTS

| | | | | |
|---|---|---|---|---|
| 2002/0012605 | A1 | 1/2002 | Tawara et al. | |
| 2021/0180160 | A1 * | 6/2021 | Hosokawa ..... | C21D 8/0226 |

FOREIGN PATENT DOCUMENTS

| | | | | |
|---|---|---|---|---|
| JP | 2011111657 | A | | 6/2011 |
| JP | 2011252212 | A | * | 12/2011 |
| JP | 2017061709 | A | | 3/2017 |
| WO | 2016090026 | A1 | | 6/2016 |

* cited by examiner

[Fig. 1]
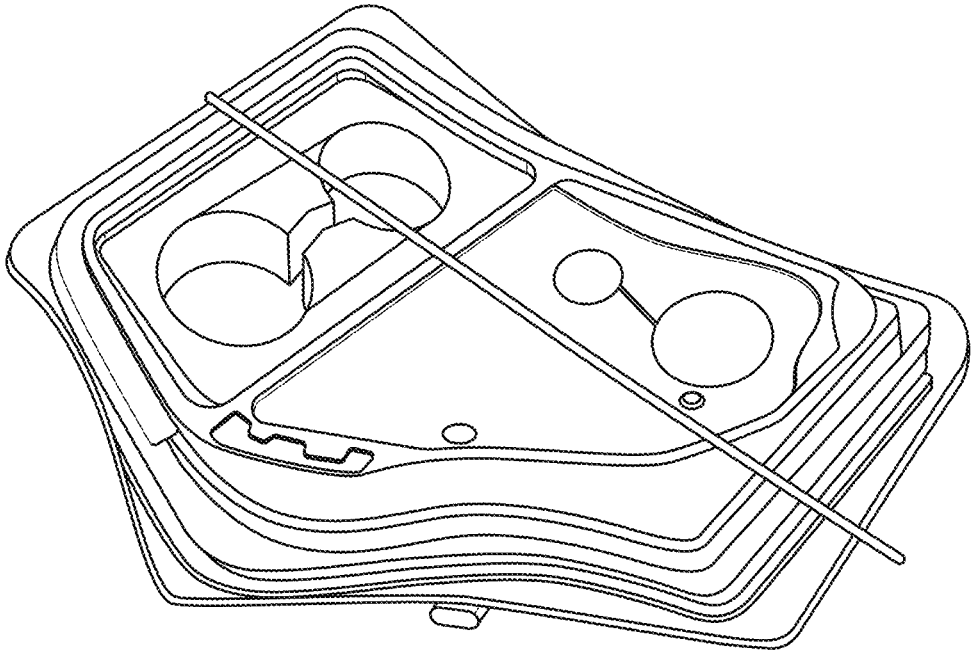
[Fig. 2]
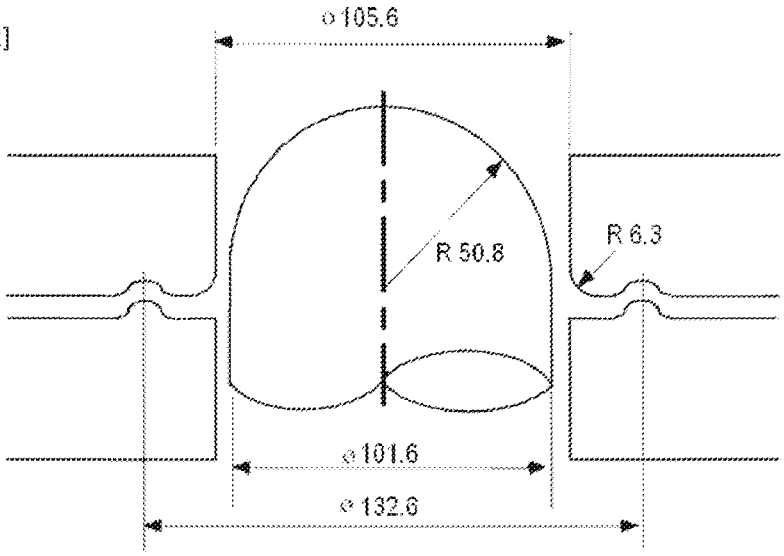

[Fig. 3]
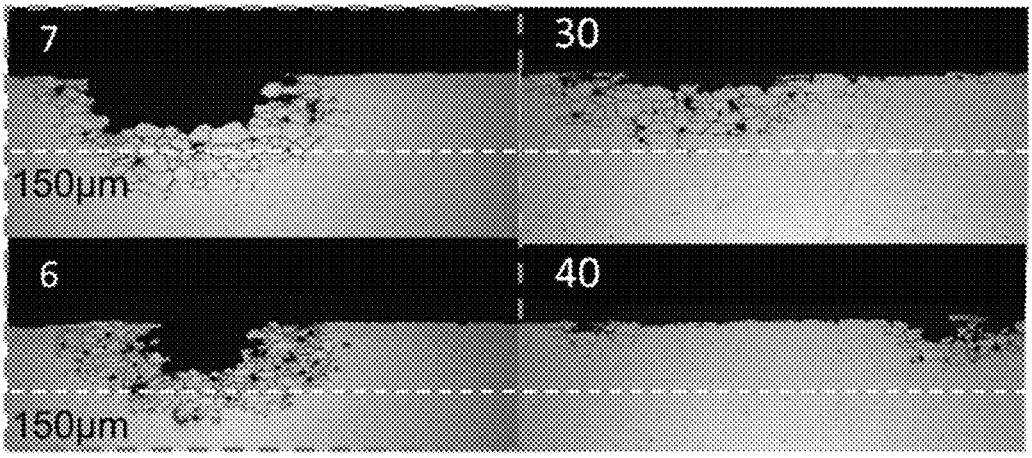
[Fig. 4]
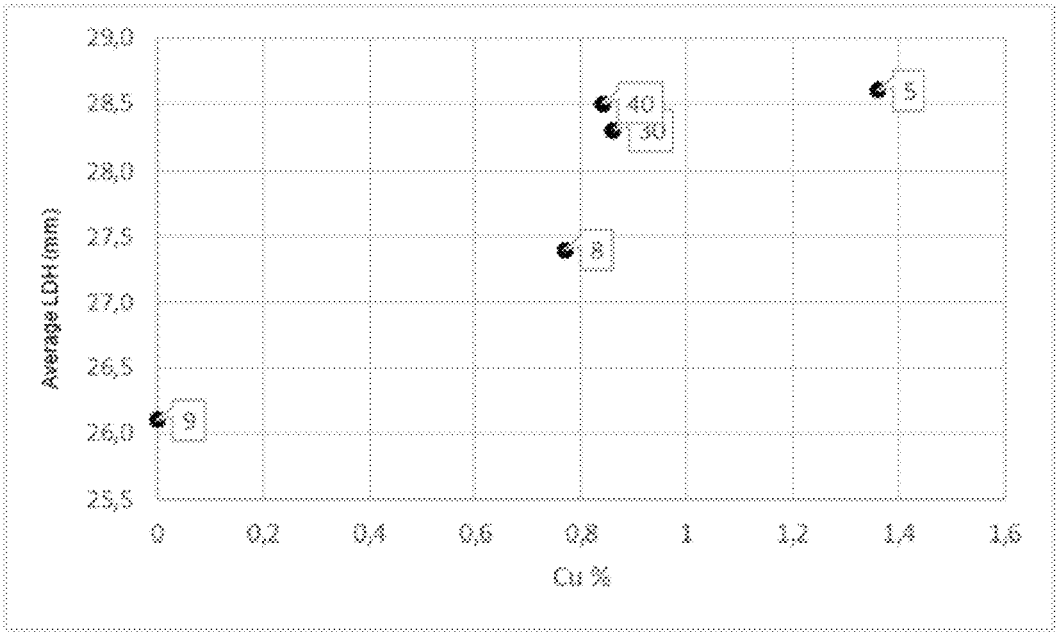

[Fig. 5]
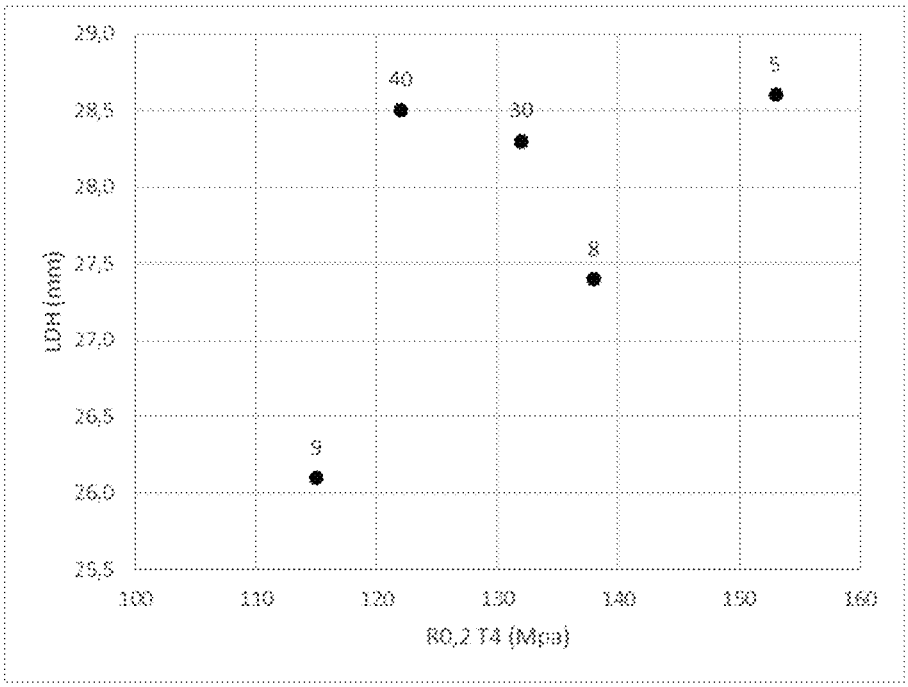
[Fig. 6]
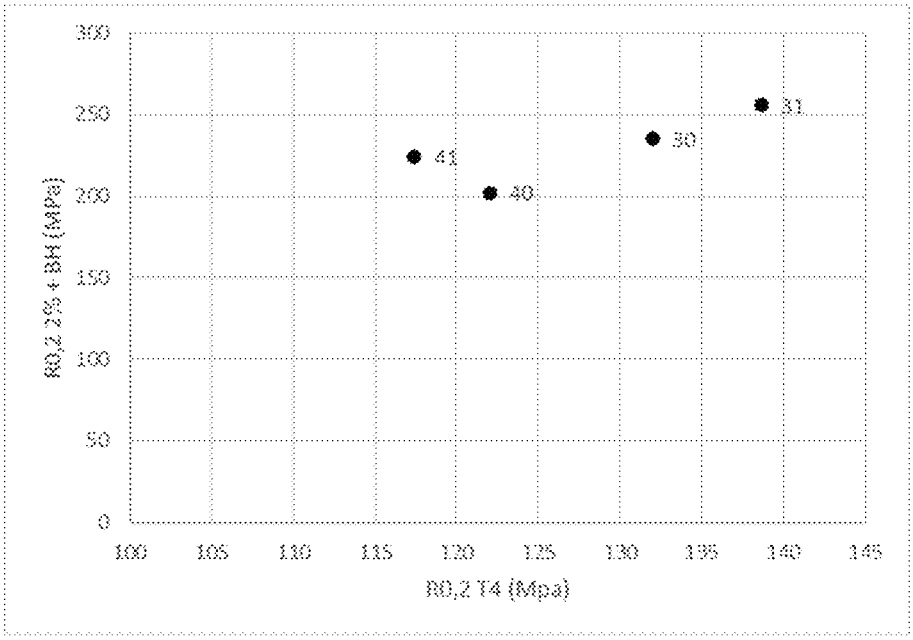

[Fig. 7]
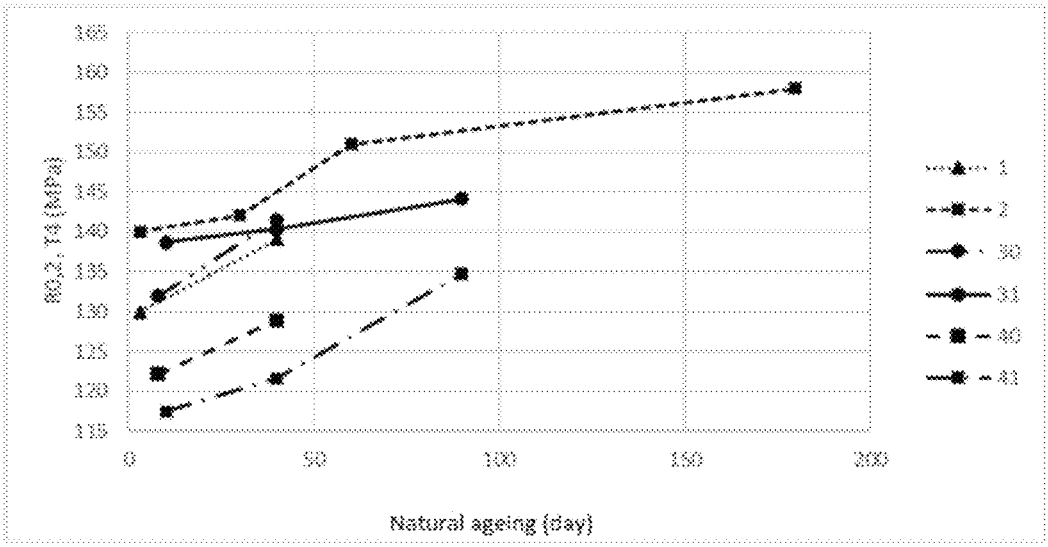
[Fig. 8]
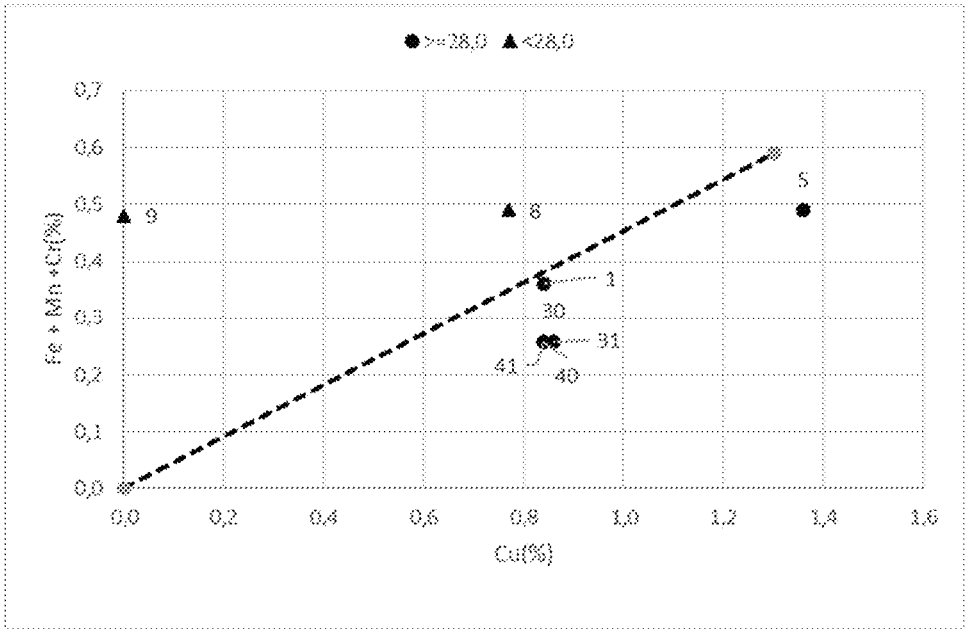

STRIP MADE OF 6XXX ALLOY AND MANUFACTURING PROCESS

CROSS-REFERENCE TO RELATED APPLICATIONS

This application is the National Stage entry of International Application No. PCT/FR2022/052168, filed 23 Nov. 2022, which claims priority to France Application No. 2112544, filed 25 Nov. 2021.

BACKGROUND

Field of the invention

The invention relates to the field of strips of aluminum alloy intended for manufacturing, by stamping, bodywork parts of the body-in-white of automobiles.

Description of Related Art

Aluminum alloys are increasingly being used in automobile construction for reducing the weight of the vehicles and thus reducing fuel consumption and greenhouse gas emissions.

Aluminum alloy strips are used in particular for manufacturing numerous parts of the "body-in-white", among which there are firstly the bodywork skin parts (or exterior panels of the bodywork) such as the front wings, roofs or tops, and hood, trunk or door skins. Manufacturing these parts requires suitability for stamping with high surface-appearance requirements. Furthermore, the linings (or interior bodywork panels) have reduced requirements in terms of surface appearance but much greater requirements for drawing compared with the bodywork skin parts.

The thesis of Michael Langille, defended at the University of Grenoble in 2019, studies the effects of adding Mg, Si and Cu on formability. By virtue of the use of calorimetry and hardness tests, the temper of the microstructure was revealed. The use of tensile tests and tests on the sensitivity of the deformation rate made it possible to determine the mechanical properties in relation to the microstructure. The parameters of mechanical properties were next included in finite element simulations to understand their effects on the formability of the alloy. This thesis established a link between the composition, the microstructures for two different treatment methods, the resulting mechanical properties and their influence on the final formability of these Al—Mg—Si—Cu alloys.

The application US20020005232 discloses a strip of aluminum alloy excellent in terms of strength and formability and having improved filiform corrosion resistance, which is used in a suitable manner for automobile bodywork panels. The aluminum alloy strip contains 0.25 to 0.6% Mg (% by mass, hereinafter the same), 0.9 to 1.1% Si, 0.6 to 1.0% Cu, and at least one element from 0.20% or less Mn and 0.10% or less Cr, the remainder consisting of Al and impurities, wherein the number of Q phases (Cu—Mg—Si—Al phases) with a size of 2 μm or more in diameter present in a matrix is 150 per $mm^2$ or more. The aluminum alloy strip is manufactured by homogenizing an ingot of an aluminum alloy having the above composition at 530° C. or more, cooling the ingot to 450° C. or less at a cooling rate of 30° C./hour or less, hot-rolling the ingot, cold-rolling the hot-rolled product, and subjecting the cold-rolled product to solution heat treatment.

The application US20020012605 discloses an aluminum alloy strip for an automobile with a chemical composition containing 0.8 to 1.5% by mass Si, 0.4 to 0.7% by mass Mg and 0.5 to 0.8% by mass Cu. The size of the crystalline grains is 10 to 40 μm. The Cu content obtained by analysing the most external surface of the aluminum alloy with a film of oxide by X-ray photoelectron spectroscopy (XPS) is 1/10 to ½ of the Cu content of the core of the aluminum alloy plate. The application JP 2011252212 discloses a method for formation treatment of an aluminum alloy material in the 6000 series, which can form a product with a more complex shape and, after artificial ageing, obtain a highly reinforced shaped product having a yield strength of 250 MPa or more. The method is provided for forming the treatment of an aluminum alloy material in the 6000 series that comprises, as % by mass, 0.3-4.0% Si, 0.3-2.0% Mg, 2.0% or less Cu, 1.5% or less Mn, 1.5% or less Fe, 2.0% or less Zn, 0.50% or less Cr, 0.50% or less Zr, 0.50% or less Ti, 0.50% or less V, and the remainder aluminum with unavoidable impurities. The method comprises the steps consisting in: implementing a solution heat treatment of aluminum alloy material; shaping the material in a die after the solution heat treatment; and implementing a quenching treatment of the material after the shaping by cooling the material in the die at a temperature of 250° C. or less.

The application JP2017061709 discloses an aluminum alloy sheet having excellent resistance to hairlines and excellent suitability for hemming.

SOLUTION: an aluminum alloy sheet composed of an aluminum alloy containing Mg and Si and excellent in terms of resistance to hairlines and hemming, has a crystal particle diameter of an L-LT surface at a central neighbourhood zone with a depth of ½ of the total thickness of the sheet in a thickness direction of the sheet from a surface of the sheet of 45 to 100 μm, a crystal particle diameter of an L-ST surface in a complete sheet of 80 or less and a zone percentage of direction of the cube in an orientation of the crystal measured on the L-LT surface of a surface of the sheet of 10% or more. The present invention also provides a method for manufacturing the aluminum alloy sheet.

The door linings, or interior panels, are often produced with strips of AA5182 alloy in the O temper since this material has excellent stamping properties and these parts have little requirement in terms of surface temper. The skin of the doors, if it is made from aluminum, is always made from alloys in the AA6xxx series by virtue of their excellent surface-appearance property. Because of the difference in composition of these aluminum alloys, recycling the doors of disused vehicles is difficult. There is therefore a need for producing alloy door linings made from AA6xxx alloy having suitability for stamping comparable to that of AA5182 in the O temper. Alloys in the 6xxx series in general have a higher yield strength than that of 5182 O. Replacing the 5182 O with an alloy in the 6xxx series can make it possible to reduce the mass of the vehicle and therefore the fuel consumption of the vehicle.

SUMMARY

The problem to be solved is developing a strip of alloy in the 6xxx series with formability under stamping that is improved compared with the traditional alloys used for door skins such as the AA6016, AA6005 and AA6022 alloys. The Limiting Dome Height: LDH characterizes the suitability for deformation during stamping. The LDH of the alloy 6005 in the T4 temper is typically 25 mm. The invention aims to obtain an excellent compromise between all the properties sought:

The formability of the strip, which is assessed in the T4 temper after natural ageing, natural ageing corresponding to the duration of transport and storage between quenching of the strip and stamping thereof in the form of a part. Formability is characterized with the LDH test and the yield strength. The objective is to obtain an LDH for a 1.2 mm strip comparable to that of a 1.2 mm strip of 5182 temper O, i.e. 28.0 mm. It is also necessary to control the yield strength to ensure that the shape is obtained during stamping with reasonable force.

The properties necessary for the use of the part on an automobile that are assessed on the finished part, and therefore after stamping of the strip, painting and curing of the paints. The curing of the paints is also known to a person skilled in the art as "bake hardening", since it allows the same time hardening, by ageing, of the stamped strip to obtain the properties necessary for use of the part in an automobile. Suitability for use on an automobile is characterized here by the yield strength of the strip after deformation of 2% and heat treatment of 185° C. for 20 minutes, representing the heat treatment for baking paints. Industrially, the paint baking can last from 10 to 30 minutes at a temperature between 17° and 195° C.

Corrosion, which is assessed on the sheet after natural ageing. Corrosion is characterized by a test of intergranular corrosion of the strip a heat treatment of 185° C. for 20 minutes.

One object of the invention is an aluminum alloy strip with a composition, as % by weight:

Si: 1.00-1.50,
Fe: <=0.30,
Mn<=0.30,
Mg: 0.20-0.44,
Cu: 0.80-1.50,
Ti: 0.03-0.15,
Cr: <=0.10,
Zn: <=0.10,
other elements: each <=0.05, together <=0.15,
remainder: Al.

Another object of the invention is a method for manufacturing a rolled strip of aluminum alloy according to the invention comprising the steps of:

a. Casting a plate, preferentially by semi-continuous vertical casting, of alloy according to the invention,
b. Homogenizing the plate at a homogenization temperature preferentially between 500° C. and 600° C.,
c. Transferring the plate thus homogenized directly to the hot roller, optionally after forced cooling,
d. Hot-rolling the plate with a hot-rolling start temperature of a minimum of 350° C. and a maximum of 550° C. and a hot-rolling end temperature of a minimum of 250° C. and a maximum of 450° C., to obtain a strip at the final hot-rolling thickness of between 2.4 mm and 10 mm,
e. Optionally cold rolling,
f. Solution heat treatment and quenching
g. Pre-ageing,
h. Natural ageing.

Another object of the invention is a method for manufacturing an automobile part comprising the successive steps:

a. Manufacturing the strip according to the invention,
b. Forming the strip,
c. Assembling as an automobile part, preferentially an automobile door, with at least one other component, preferentially made from 6xxx alloy, preferentially an AA6016 or AA6005 or AA6022 alloy, this other component preferentially being manufactured from a sheet, preferentially by stamping,
d. Heat treatment, preferably by baking the paints.

Another object of the invention is an automobile part, in particular an automobile door, obtained by the method according to the invention.

BRIEF DESCRIPTION OF THE DRAWINGS

FIG. 1: This figure shows an automobile door lining. It shows in particular the stamping depth achieved.

FIG. 2: This figure shows the tool for measuring the LDH of a strip.

FIG. 3: This figure shows the results of an intergranular corrosion test.

FIG. 4: This graph shows the value of the LDH as a function of the Cu content.

FIG. 5: This graph shows the value of the LDH as a function of the yield strength in the T4 temper of the strip.

FIG. 6: This graph shows the yield strength with 2% elongation and then annealing of the paints as a function of the yield strength in the T4 temper of the strip.

FIG. 7: This graph shows the natural ageing of the strip.

FIG. 8: This graph shows the strips with an LDH greater than or less than 28 mm in a graph of the Cu content as a function of the Fe, Mn, and Cr content.

DETAILED DESCRIPTION OF A PREFERRED EMBODIMENT

All the aluminum alloys in question hereinafter are, unless mentioned to the contrary, designated in accordance with the rules and designations defined by the "Aluminum Association" in the "Registration Record Series" that it publishes regularly. Unless mentioned to the contrary, the compositions are expressed as % by weight. The expression 1.4 Cu means that the copper content expressed as % by weight is 1.4%.

The metallurgical tempers in question are designated in accordance with the European standard EN 515.

The static tensile mechanical characteristics, in other words the ultimate tensile strength Rm, the conventional yield strength at 0.2% elongation Rp0.2, the striction elongation Ag % and the elongation at rupture A % are determined by a tensile test in accordance with NF EN ISO 6892-1, the sampling and the direction of the test being defined by EN 485-1.

The strain-hardening coefficient n is evaluated in accordance with EN ISO 10275.

The modulus of elasticity is measured in accordance with ASTM 1876.

The Lankford coefficient of anisotropy is measured in accordance with EN ISO 10113.

The bending angles, called alpha norm, are determined by 3-point bending test in accordance with NF EN ISO 7438 and the VDA 238-100 and VDA 239-200 version 2017 procedures.

Unless specified otherwise, the definitions of the standard EN 12258 apply.

The LDH parameter is widely used for re-evaluating the suitability of the strips for stamping. It has been the subject of numerous publications, in particular the one by R. Thompson, "The LDH test to evaluate sheet metal formability-Final Report of the LDH Committee of the North American Deep Drawing Research Group", SAE conference, Detroit, 1993, SAE Paper no 930815. It is a case of a test on stamping of a blank locked at the periphery by a ring. The blank-clamping pressure is adjusted to avoid slipping in the ring. The blank, of dimensions 120 mm×160 mm, is stressed in a mode close to planar deformation. The punch used is hemispherical. FIG. 2 specifies the dimensions of the tools used for implementing this test. The lubrication between the punch and the strip is provided by graphited grease. The speed of descent of the punch is 50 mm/min. The so-called LDH value is the value of the movement of the punch at rupture, i.e. the limit depth of the stamping. It corresponds in fact to the mean of three tests, giving a 95% confidence range on the measurement of 0.2 mm.

The standard for measuring intergranular corrosion is ASTM G110.

Ambient temperature is any temperature compatible with the work of humans from 5 to 35° C.

The strip according to the invention is an aluminum alloy consisting of the following elements:

Si: Silicon is, with magnesium, the prime alloy element of the aluminum-magnesium-silicon systems (family AA6xxx) to form the intermetallic compounds Mg2Si or Mg5Si6 that contribute to the structural hardening of these alloys. The Si is in excess with respect to the Mg, the Si content being at least 0.50% greater than that of the Mg. The purpose of this excess is to obtain good ductility necessary for the forming of the strip. The hardening obtained by the Mg2Si or Mg5Si6 precipitates is not sufficient to obtain the mechanical properties and adding Cu is necessary, as explained in the corresponding paragraph. The Si content is at a minimum 1.00% and at a maximum 1.50%, or 1.40% or 1.35% or 1.30% or 1.25% or 1.20% or 1.10%. In one embodiment, the Si content is at a minimum 1.10% and at a maximum 1.50%, or 1.40% or 1.35% or 1.30% or 1.25% or 1.20%. In another embodiment, the SI content is at a minimum 1.20% and at a maximum 1.50%, or 1.40% or 1.35% or 1.30% or 1.25%; this embodiment and in particular the SI range: 1.20-1.30% is a preferred mode. In yet another embodiment, the SI content is at a minimum 1.25% and at a maximum 1.50%, or 1.40% or 1.35% or 1.30%. In yet another embodiment, the SI content is at a minimum 1.30% and at a maximum 1.50%, or 1.40% or 1.35%. In yet another embodiment, the SI content is at a minimum 1.35% and at a maximum 1.50%, or 1.40%. In yet another embodiment, the SI content is at a minimum 1.40% and at a maximum 1.50%.

Fe: Iron is generally considered to be an undesirable purity and thus the maximum iron content is 0.30%. The presence of intermetallic compounds containing iron is in general associated with a reduction in local formability. Reducing the Fe content improves the formability measured with the LDH. However, alloys very pure in Fe are expensive. An advantageous compromise is an Fe content of less than or equal to 0.30% and greater than or equal to 0.05%. In one embodiment the Fe content is less than 0.25% and the minimum Fe content is 0.05% or 0.10% or 0.15% or 0.20%, the range 0.10-0.25 being particularly advantageous. In another embodiment the Fe content is less than 0.20% and the minimum Fe content is 0.05% or 0.10% or 0.15%. In yet another embodiment the Fe content is less than 0.15% and the minimum Fe content is 0.05% or 0.10%.

Mn: Manganese has a similar effect to iron through its contribution to the common intermetallic precipitates. Reducing the Mn content improves formability measured with the LDH. The Mn content is at a maximum 0.30% and at a minimum 0% or 0.05%, or 0.10%, or 0.15%, or 0.20%, or 0.25%. In one embodiment, the Mn content is at a maximum 0.25% and at a minimum 0%, 0.05%, 0.10%, 0.15% or 0.20%. In another embodiment, the Mn content is at a maximum 0.20% and at a minimum 0%, 0.05%, 0.10%, or 0.15%. In another embodiment, the Mn content is at a maximum 0.15% and at minimum 0%, 0.05%, or 0.10%. In another embodiment, the Mn content is at a maximum 0.10% and at a minimum 0%, 0.05%.

Mg: Generally, the level of mechanical characteristics of the alloys in the AA6xxx family increases with the magnesium content. Combined with silicon to form the intermetallic compounds $Mg_2Si$ or $Mg_5Si_6$, magnesium helps to increase the mechanical properties. However, the Mg content must be limited since it excessively increases the yield strength in the T4 temper, which increases the stamping force and makes this operation more difficult. The Mg content can be combined with the Cu content to obtain a good property compromise both in the T4 temper, such as the yield strength or the LDH, and in the use temper, such as the yield strength after 2% elongation and then treatment of the paints. The Mg content a minimum of 0.20% and a maximum of 0.44% or 0.42% or 0.40% or 0.38% or 0.36% or 0.34% or 0.32% or 0.30% or 0.25%. In one embodiment, the Mg content is a minimum of 0.25% and a maximum of 0.44% or 0.42% or 0.40% or 0.38% or 0.36% or 0.35% or 0.34% or 0.32% or 0.30%, the range 0.25-0.35% being particularly advantageous. In yet another embodiment, the Mg content is a minimum of 0.30% and a maximum of 0.44% or 0.42% or 0.40% or 0.38% or 0.36% or 0.34% or 0.32%. In yet another embodiment, the Mg content is at a minimum 0.32% and at a maximum 0.44% or 0.42% or 0.40% or 0.38% or 0.36% or 0.34%. In yet another embodiment, the Mg content is at a minimum 0.34% and at a maximum 0.44% or 0.42% or 0.40% or 0.38% or 0.36%. In yet another embodiment, the Mg content is at a minimum 0.36% and at a maximum 0.44% or 0.42% or 0.40% or 0.38%. In yet another embodiment, the Mg content is at a minimum 0.36% and at a maximum 0.44% or 0.42% or 0.40% or 0.38%. In yet another embodiment, the Mg content is at a minimum 0.38% and at a maximum 0.44% or 0.42% or 0.40%. In yet another embodiment, the Mg content is at a minimum 0.40% and at a maximum 0.44% or 0.42%. In yet another embodiment, the Mg content is at a minimum 0.42% and at a maximum 0.44%.

Cu: In the alloys of the AA6000 family, copper is an element participating in the hardening precipitation but is known for degrading the corrosion resistance. As explained previously, it is necessary to add Cu to harden the strip. Surprisingly, adding copper increases the formability of the strip characterized in LDH. In fact a person skilled in the art expects that usually hardening causes a reduction in elongation and suitability for stamping. The copper content is at a maximum 1.50% and at a minimum 0.80% or 0.85% or 0.90% or 0.95% or 1.00% or 1.10% or 1.20% or 1.30% or 1.40%. In one embodiment, the copper content is at a maximum 1.40% and at a minimum 0.80% or 0.85% or 0.90% or 0.95% or 1.00% or 1.10% or 1.20% or 1.30%. In another embodiment, the copper content is at a maximum 1.30% and at a minimum 0.80% or 0.85% or 0.90% or 0.95% or 1.00% or 1.10% or 1.20%. In another embodiment, the copper content is at a maximum 1.20% and at a minimum 0.80% or 0.85% or 0.90% or 0.95% or 1.00% or 1.10%. In another embodiment, the copper content is at a maximum 1.10% and at a minimum 0.80% or 0.85% or 0.90% or 0.95% or 1.00%. In another embodiment, the copper content is at a maximum 1.00% and at a minimum 0.80% or 0.85% or 0.90% or 0.95%. In another embodiment, the copper content is at a maximum 0.95% and at a minimum 0.80% or 0.85% or 0.90%. In another embodiment, the copper content is at a maximum 0.90% and at a minimum 0.80% or 0.85%, the range 0.80-0.90% is particularly preferred. In another embodiment, the copper content is at a maximum 0.85% and at a minimum 0.80%.

Ti: This element can favor hardening by solid solution leading to the required level of mechanical characteristics and this element also has a favorable effect on ductility in service and resistance to corrosion. In order to compensate for the presence of Cu in the alloy of the strip, a minimum Ti content of 0.03% is necessary for ensuring corrosion resistance while limiting the depth of intergranular corrosion pits to 150 μm for the strip according to the invention after 20 minutes at 185° C. On the other hand, a maximum content of 0.15% for Ti is required for avoiding conditions of forming primary phases during vertical casting, which has a detrimental effect on all the properties claimed. In one embodiment, the minimum Ti content is 0.04% and a maximum content is 0.15%, or 0.14% or 0.13% or 0.12% or 0.11% or 0.10% or 0.09% or 0.08% or 0.07% or 0.06% or 0.05%. In another embodiment, the minimum Ti content is 0.05% and the maximum content is 0.15%, or 0.14% or 0.13% or 0.12% or 0.11% or 0.10% or 0.09% or 0.08% or 0.07% or 0.06%, the Ti range 0.05-0.15 is particularly advantageous. In another embodiment, the minimum Ti content is 0.06% and the maximum content is 0.15%, or 0.14% or 0.13% or 0.12% or 0.11% or 0.10% or 0.09% or 0.08% or 0.07%. In another embodiment, the minimum Ti content is 0.07% and the maximum content is 0.15%, or 0.14% or 0.13% or 0.12% or 0.11% or 0.10% or 0.09% or 0.08%. In another embodiment, the minimum Ti content is 0.08% and the maximum content is 0.15%, or 0.14% or 0.13% or 0.12% or 0.11% or 0.10% or 0.09%. In another embodiment, the minimum Ti content is 0.09% and the maximum content is 0.15%, or 0.14% or 0.13% or 0.12% or 0.11% or 0.10%. In another embodiment, the minimum Ti content is 0.10% and the maximum content is 0.15%, or 0.14% or 0.13% or 0.12% or 0.11%. In another embodiment, the minimum Ti content is 0.11% and the maximum content is 0.15%, or 0.14% or 0.13% or 0.12%. In another embodiment, the minimum Ti content is 0.12% and the maximum content is 0.15%, or 0.14% or 0.13%. In another embodiment, the minimum Ti content is 0.13% and the maximum content is 0.15%, or 0.14%.

Cr: It can be added to refine the grains and to stabilise the structure. Reducing the Cr content improves the formability measured with the LDH. The Cr content is a maximum of 0.10%, preferably less than 0.05%.

Zn: The content is a maximum of 0.10% in order not to degrade the corrosion resistance. Zn being an addition element in aluminum alloys, it is advantageous to accept it for the purpose of recycling aluminum offcuts and waste, in particular of disused vehicles. This is because Zn is used in some alloys of some components such as brazed heat exchangers. In one embodiment, the Zn content is less than 0.05%. In another embodiment, Zn forms part of the other elements. In another embodiment, the Zn content is a maximum of 0.03%.

The other elements are typically impurities, the proportion of which is kept below 0.05%, the whole being less than 0.15%, the remainder is aluminum.

The method for manufacturing the strips according to the invention includes the casting of a plate, preferably by vertical semicontinuous casting followed by homogenization thereof. The plate is cast with an alloy according to the previously described composition. The preferential dimensions of the plates according to the invention are 200 mm to 600 mm in thickness, 1000 to 3000 mm in width and 2000 to 8000 mm in length.

The plate is homogenized at a homogenization temperature preferably of between 500 C and 600° C. In one embodiment, the homogenization temperature is a maximum of 580° C. and a minimum of 500° C., or 520° C., or 540° C., or 560° C. In another embodiment, the homogenization temperature is a maximum of 560° C. and a minimum of 500° C., or 520° C., or 540° C., in particular the range between 540° C. and 560° C. is particularly advantageous. In one embodiment, the homogenization temperature is a maximum of 540° C. and a minimum of 500° C., or 520° C. In one embodiment, the homogenization temperature is a maximum of 520° C. and a minimum of 500° C. The duration of homogenization is preferentially a minimum of 1 hour.

The homogenized plate is transferred directly to the hot roller, i.e. without cooling to ambient temperature. In one embodiment, the temperature at the start of hot rolling is the homogenization temperature, optionally a cooling of 5° C. to 10° C. may take place during the transfer between the homogenization and the start of hot rolling. In another embodiment, the plate is cooled from the homogenization temperature to the temperature of start of hot rolling by forced cooling. This forced cooling is preferentially implemented with a direct cooling rate of at least 150° C. per hour. Advantageously, the direct cooling rate is a minimum of 500° C./hour.

The cooling can typically be implemented by a machine such as the one described by the application WO2016012691. Preferentially, this cooling is done in two steps, one of spraying and the other of uniformization. Optionally, this cooling can be implemented in two passes through a machine such as the one described by the application WO2016012691.

The plate is next hot-rolled.

The temperature of start of hot rolling is a minimum of 350° C. and a maximum of 550° C. or 530° C. or 510° C. or 490° C. or 470° C. or 450° C. or 430° C. or 410° C. or 390° C. or 370° C. In one embodiment, the temperature of start of hot rolling is a minimum of 370° C. and a maximum of 550° C. or 530° C. or 510° C. or 490° C. or 470° C. or 450° C. or 430° C. or 410° C. or 390° C. In another embodiment, the temperature of start of hot rolling is a minimum of 390° C. and a maximum of 550° C. or 530° C. or 510° C. or 490 C or 470° C. or 450° C. or 430° C. or 410° C. In another embodiment, the temperature of start of hot rolling is a minimum of 410° C. and a maximum of 550° C. or 530° C. or 510° C. or 490° C. or 470° C. or 450° C. or 430° C. In another embodiment, the temperature of start of hot rolling is a minimum of 430° C. and a maximum of 550° C. or 530° C. or 510° C. or 490° C. or 470° C. or 450° C. In another embodiment, the temperature of start of hot rolling is a minimum of 450° C. and a maximum of 550° C. or 530° C. or 510° C. or 490° C. or 470° C. In another embodiment, the temperature of start of hot rolling is a minimum of 470° C. and a maximum of 550° C. or 530° C. or 510° C. or 490° C. In another embodiment, the temperature of start of hot rolling is a minimum of 490° C. and a maximum of 550° C. or 530° C. or 510° C. In another embodiment, the temperature of start of hot rolling is a minimum of 510° C. and a maximum of 550° C. or 530° C. In another embodiment, the temperature of start of hot rolling is a minimum of 530° C. and a maximum of 550° C. In a preferred embodiment, the temperature of start of hot rolling is the homogenization temperature, optionally a cooling of 5° C. to 10° C. may have taken place during the transfer between the homogenization and the start of hot rolling. In another preferred embodiment, the temperature of start of hot rolling is obtained by the cooling described above, of 140, or 150° C. or 160° C. from the homogenization temperature.

In the end of the hot rolling, the plate has been rolled into a strip at the final hot-rolling thickness of between 2.4 and 10 mm, preferentially from 3 to 7 mm. The temperature of end of hot rolling is a minimum of 250° C. and a maximum of 450° C. or 430° C. or 410° C. or 390° C. or 370° C. or 350° C. or 330° C. or 310° C. or 290° C. or 270° C., the range from 250° C. to 330° C. is particularly preferred, in particular when there has been forced cooling between they homogenization and the start of hot rolling. In one embodiment, the temperature of end of hot rolling is a minimum of 270° C. and a maximum of 450° C. or 430° C. or 410° C. or 390° C. or 370° C. or 350° C. or 330° C. or 310° C. or 290° C. In another embodiment, the temperature of end of hot rolling is a minimum of 290° C. and a maximum of 450° C. or 430° C. or 410° C. or 390° C. or 370° C. or 350° C. or 330° C. or 310° C., the range from 290° C. to 390° C. is particularly preferred, in particular when there is no forced cooling between the homogenization and the start of hot rolling. In another embodiment, the temperature of end of hot rolling is a minimum of 310° C. and a maximum of 450° C. or 430° C. or 410° C. or 390° C. or 370° C. or 350° C. or 330° C. In another embodiment, the temperature of end of hot rolling is a minimum of 330° C. and a maximum of 450° C. or 430° C. or 410° C. or 390° C. or 370° C. or 350° C. In another embodiment, the temperature of end of hot rolling is a minimum of 350° C. and a maximum of 450° C. or 430° C. or 410° C. or 390° C. or 370° C. In another embodiment, the temperature of end of hot rolling is a minimum of 370° C. and a maximum of 450° C. or 430° C. or 410° C. or 390° C. In another embodiment, the temperature of end of hot rolling is a minimum of 390° C. and a maximum of 450° C. or 430° C. or 410° C. In another embodiment, the temperature of end of hot rolling is a minimum of 410° C. and a maximum of 450° C. or 430° C. In another embodiment, the temperature of end of hot rolling is a minimum of 430° C. and a maximum of 450° C.

The cooling between the start and the end of the hot rolling results from the normal heat exchange of the plate with the air at ambient temperature of the factory, with the hot equipment of the rolling mill such as for example, non-limitatively, the cylinders of the conveying rollers, as well as with the usual lubrication or cooling fluids.

The strip is next optionally cold rolled. Annealing may take place before or after the cold rolling. Intermediate annealing may also take place between two cold-rolling steps. The annealing may take place on a static furnace or on a continuous furnace.

The preferential thickness of the strip obtained after hot rolling, optionally after cold rolling, is between 0.2 mm and 6 mm, preferentially from 0.7 to 3.2 mm.

The strip is next solution heat-treated, preferably in a continuous furnace, and then quenched. The temperature of solution heat treatment is advantageously a maximum of 580° C. and a minimum of 540° C. or 550° C. or 560° C. or 570° C. In one embodiment, the temperature of solution heat treatment is a maximum of 570° C. and a minimum of 540° C. or 550° C. or 560° C. In one embodiment, the temperature of solution heat treatment is a maximum of 570° C. and a minimum of 540° C. or 550° C. or 560° C. In one embodiment, the temperature of solution heat treatment is a maximum of 560° C. and a minimum of 540° C. or 550° C., The range from 540° C. to 560° C. is particularly preferred. In one embodiment, the temperature of solution heat treatment is a maximum of 550° C. and a minimum of 540° C. The duration of solution heat treatment is between 15 and 60 seconds, preferentially from 15 to 30° C. The quenching can be done with water or with air. The strip is next cooled to ambient temperature. Preferentially, the strip is cooled only to the temperature of a surface treatment when a surface treatment, known to persons skilled in the art, is applied directly after the quenching and before pre-ageing. This surface-treatment temperature is between 5° and 70° C. Not cooling to ambient temperature avoids an operation of reheating the strip.

Next the strip is pre-aged, preferably at a pre-ageing temperature of between 5° and 100° C. In one embodiment, the pre-ageing temperature is between 8° and 90° C. In another embodiment the pre-ageing temperature is above 65° C., preferentially above 70° C., and preferentially below 90° C. and more preferentially below 85° C. This embodiment makes it possible to increase the response to baking of the paints, which is the difference between the yield strength after 2% elongation and then 20 minutes at 185° C. and that of the T4 temper. This embodiment also makes it possible to limit the hardening of the strip during natural ageing. Preferentially, this embodiment is combined with an Mg content of less than or equal to 0.34%. This Mg content allows a lower yield strength in the T4 temper to facilitate the stamping of the strip while having good response to baking of the paints. In one embodiment, the strip is maintained for 8 hours at the pre-ageing temperature and then cooled to ambient temperature. In a preferred embodiment, the pre-ageing is obtained by coiling the strip at the pre-ageing temperature, the strip is not maintained at the pre-ageing temperature, and then the coiled strip cools naturally to ambient temperature over a period of between 8 hours and 24 hours.

The strip in the T4 temper next ages naturally at ambient temperature for between 72 hours and 6 months.

The strip thus obtained is a flat product suitable for stamping.

The yield strength of the strip in the T4 temper must not be too great to avoid excessive force during stamping. The yield strength of the strip in the T4 temper must not be too low since otherwise the yield strength after 2% elongation and then 20 minutes at 185° C. would be insufficient for use on a vehicle. The strip advantageously has a yield strength of a minimum of 100 MPa or 110 MPa and a maximum of 170 MPa or 150 MPa or 140 MPa. In one embodiment, the strip has a yield strength of a minimum of 140 MPa and a maximum of 170 MPa or 150 MPa. In one embodiment, the strip has a yield strength of a minimum of 150 MPa and a maximum of 170 MPa.

The invention is also a method for manufacturing an automobile part comprising the successive steps:

a. Manufacturing the strip according to the invention,
b. Forming the strip, preferably by stamping, preferably as an automobile door lining,
c. Assembling as an automobile part, preferentially an automobile door, with at least one other component, preferentially made from 6xxx alloy, preferentially an AA6016 or AA6005 or AA6022 alloy, this other component preferentially being manufactured from a sheet, preferentially by stamping,
d. Heat treatment, preferably by baking the paints.

Forming the strip does not require heat treatment other than those necessary during the manufacture of the strip.

The automobile door obtained serves for producing the opening panels of an automobile such as the hood, the doors, the tailgate or the trunk lids.

The at least one other component is advantageously a 6xxx alloy to facilitate recycling of the disused vehicles.

Preferentially, the at least one other component is an AA6016 or AA6005 or AA6022 alloy since these alloys, known to a person skilled in the art, make it possible to obtain a surface quality after painting necessary for a visible component of the exterior of the automobile.

The automobile part undergoes the treatments known to a person skilled in the art, in particular painting, and then heat treatment, preferably by baking the paints, known to a person skilled in the art by the term "bake hardening".

The invention is also an automobile part, in particular an automobile door, obtained by the method according to the invention.

In one embodiment, the strip according to the invention and the automobile part, preferentially the door, according to the invention has a yield strength, after 2% elongation and then 20 minutes at 185° C., of a minimum of 200 MPa, preferentially 210 MPa, preferentially 220 MPa, more preferentially 230 MPa, and/or a maximum of 270 MPa or 290 MPa or 310 MPa.

In one embodiment, the strip in the T4 temper has an LDH preferentially greater than 28.0 mm, measured at a thickness of 1.2 mm, to obtain the deformation necessary for stamping. Preferentially, to obtain an LDH greater than 28.0 mm, the impurity content, consisting of Fe, Mn and Cr, (Fe+Mn+Cr)≤C+0.454*Cu, where C is a constant equal to 0.10%, preferentially 0.05%, more preferentially 0.00%. This inequality shows that the invention makes it possible to adjust the Cu content according to the sum of the Fe, Mn and Cr contents, which can be assimilated to the purity of the metal used, while maintaining the LDH level. This suitability for adjusting the composition make possible to optimize other properties of the strip according to the use sought, as described below in two embodiments.

In a particular implementation of this embodiment, a low Cu content and high purity (a low Mn, Fe and Cr content) is advantageous for obtaining a strip with a low yield strength, easier to stamp. A low Cu content corresponds to a composition the maximum value of which, from the aforementioned maximum values, is less than or equal to 1.00%, preferentially 0.90%. A high Fe, Mn and Cr purity corresponds to the aforementioned compositions of these elements that respect the inequality described above. The yield strength in the T4 temper may be low, and thus the aforementioned maximum is preferentially less than or equal to 150 MPa, preferentially 140 MPa after no more than 10 days of natural ageing. This low yield strength in the T4 temper can be compensated for, as explained above, by the Mg content and the pre-ageing temperature to obtain a higher yield strength after 2% elongation and then 20 minutes at 185° C. that is higher than 200 MPa, preferentially higher than 220 MPa.

In another implementation of this embodiment, a high Cu content is advantageous for recycling alloys with a high Fe, Mn, and Cr impurity content and for obtaining a high yield strength after 2% elongation and then 20 minutes at 185° C. A high Cu content corresponds to a composition the minimum value of which, among the aforementioned minimum values, is greater than or equal to 1.00%. A high Fe, Mn and Cr impurity content corresponds to the aforementioned compositions of these elements where the sum of the maximum of these elements respects the inequality (Fe+Mn+Cr)≤ C+0.454*Cu.

Examples

Foundry plates were cast by vertical semicontinuous casting in accordance with the compositions in table 1. Plates 1, 2, 3 and 4 are examples of the invention.

Plates 1 to 4 are industrial plates, with a thickness of 660 mm for plates 1 and 2, and a thickness of 525 mm for plates 3 and 4.

Plates 5 to 9 are laboratory plates 50 mm thick.

TABLE 1

| Plate | Si | Fe | Cu | Mn | Mg | Cr | Zn | Ti |
|---|---|---|---|---|---|---|---|---|
| 1 | 1.25 | 0.20 | 0.84 | 0.15 | 0.33 | 0.01 | 0.01 | 0.090 |
| 2 | 1.27 | 0.19 | 0.81 | 0.15 | 0.40 | 0.01 | 0.01 | 0.090 |
| 3 | 1.18 | 0.17 | 0.86 | 0.08 | 0.39 | 0.008 | 0.006 | 0.100 |
| 4 | 1.23 | 0.16 | 0.84 | 0.09 | 0.28 | 0.008 | 0.006 | 0.100 |
| 5 | 1.32 | 0.25 | 1.36 | 0.21 | 0.29 | 0.03 | | 0.020 |
| 6 | 1.31 | 0.24 | 0.83 | 0.20 | 0.27 | 0.03 | | 0.020 |
| 7 | 1.26 | 0.12 | 0.72 | 0.06 | 0.27 | 0.01 | | 0.020 |
| 8 | 1.28 | 0.25 | 0.77 | 0.21 | 0.28 | 0.03 | | 0.020 |
| 9 | 1.27 | 0.24 | 0 | 0.21 | 0.27 | 0.03 | | 0.020 |

These foundry plates were next homogenized, hot rolled, cold rolled into strips that were solution heat treated and then quenched in accordance with the parameters in table 2 and table 3. Plates 3 and 4 were subjected to cooling between the discharge from homogenization and the start of hot rolling with a rate of 250° C./hour.

TABLE 2

| | Homogenization | | Hot rolling | | |
|---|---|---|---|---|---|
| Plate | Duration (h) | Temperature (° C.) | T-entry (° C.) | Exit thickness (mm) | Exit temperature (° C.) |
| 1 | 44 | 550 | 545 | 6.4 | 342 |
| 2 | 68 | 550 | 544 | 3.6 | 342 |
| 3 | 3 | 560 | 412 | 4.0 | 279 |
| 4 | 3 | 560 | 408 | 4.0 | 271 |
| 5 | 8 | 550 | 550 | 3.9 | 300 |
| 6 | 8 | 550 | 550 | 3.9 | 300 |
| 7 | 8 | 550 | 550 | 3.9 | 300 |
| 8 | 8 | 550 | 550 | 3.9 | 300 |
| 9 | 8 | 550 | 550 | 3.9 | 300 |

The cold-rolling parameters are given in table 3.

TABLE 3

| | CR | |
|---|---|---|
| Plate | Exit thickness (mm) | Reduction (%) |
| 1 | 2.2 | 65% |
| 2 | 1.0 | 72% |
| 3 | 1.2 | 70% |
| 4 | 1.2 | 70% |
| 5 | 1.2 | 69% |
| 6 | 1.2 | 69% |
| 7 | 1.2 | 69% |
| 8 | 1.2 | 69% |
| 9 | 1.2 | 69% |

Solution heat treatment and quenching were implemented in accordance with the parameters in table 4.

The rate of quenching of the air-quenched strips was 30° C./sec.

The strips were next solution heat-treated, quenched and pre-aged in accordance with table 4. Strips 3 and 4 were cut into several pieces that were subjected to the different treatments. Strips 1 and 2 were quenched to the temperature of 70° C., strips 3 and 4 were quenched to the temperature of 50° C. The strips 31, 41, 5, 6, 7, 8 and 9 were quenched to the temperature of 25° C. The pre-ageing is our implemented either by exposing the strip to a temperature for the period in table 4, or by coiling the strip, the coil obtained cooling to ambient temperature of approximately 21° C. in 24 hours.

TABLE 4

| | | Solution heat treatment and quenching | | | pre-ageing | |
|---|---|---|---|---|---|---|
| plate | strip | Temperature (° C.) | Duration (s) | quenching | pre-ageing (° C.) | pre-ageing |
| 1 | 1 | 547 | 27 | Water | 71 | coil |
| 2 | 2 | 550 | 25 | Air | 65 | coil |
| 3 | 30 | 548 | 19 | Air | 62 | coil |
| 3 | 31 | 550 | 60 | water | 80 | 8 h |
| 4 | 40 | 552 | 22 | air | 62 | coil |
| 4 | 41 | 550 | 60 | water | 80 | 8 h |
| 5 | 5 | 550 | 60 | water | 85 | 8 h |
| 6 | 6 | 550 | 60 | water | 85 | 8 h |
| 7 | 7 | 550 | 60 | water | 85 | 8 h |
| 8 | 8 | 550 | 60 | water | 85 | 8 h |
| 9 | 9 | 550 | 60 | water | 85 | 8 h |

Strips 6, 7, 30, and 40 were exposed to an intergranular corrosion test after 20 minutes at 185° C. The presence of Ti in strips 30 and 40 makes it possible to limit the intergranular corrosion to a depth of less than 150 μm compared with strips 6 and 7, as shown on FIG. 3.

TABLE 5

| | Natural | T4 temper | | | | | | | | |
|---|---|---|---|---|---|---|---|---|---|---|
| strip | ageing (day) | R0.2 (MPa) | Rm (MPa) | Ag (%) | A50 (%) | n4-6 (%) | n10-15 (%) | r10 (%)% | LDH (mm) | BH R, 02 |
| 1 | 3 | 130 | 263 | 24.3 | 30.7 | 0.30 | 0.28 | 0.5 | 32.6 | 244 |
| 2 | 6 | 140 | 291 | 25.2 | 29.0 | 0.30 | 0.29 | 1.2 | | 264 |
| 30 | 8 | 132 | 277 | 27.5 | 29.9 | 0.30 | 0.30 | 1.5 | 28.3 | 235 |
| 31 | 10 | 139 | 290 | 27.0 | 32.1 | 0.30 | 0.30 | 1.4 | 28.0 | 255 |
| 40 | 8 | 122 | 264 | 26.0 | 28.0 | 0.30 | 0.29 | 1.6 | 28.5 | 202 |
| 41 | 10 | 117 | 265 | 25.1 | 32.1 | 0.32 | 0.31 | 1.5 | 28.3 | 224 |
| 5 | 10 | 153 | 304 | 25.7 | 29.6 | 0.31 | 0.30 | 0.6 | 28.6 | 226 |
| 8 | 10 | 138 | 279 | 24.4 | 28.1 | 0.32 | 0.29 | 0.6 | 27.4 | 225 |
| 9 | 10 | 115 | 236 | 21.8 | 26.3 | 0.30 | 0.26 | 0.5 | 26.1 | 209 |

Strips 1, 2, 30, 40, 5, 8, and 9 in the T4 temper were characterized for formability with the LDH test as well as their mechanical property in table 5. The last column is the R0.2 measured after 2% elongation and then 20 minutes at 185° C. The LDH values are the mean value of the measurement in the rolling direction and of the measurement in the direction across rolling. The other mechanical properties were measured in the direction across rolling.

FIGS. 4 and 5 show these results in particular for strips 30, 40, 5, 8, and 9. The LDH of coils 5, 8, and 9 increase with the copper content, which also causes an increase in the proportion of the yield strength of said strips. Strips 30 and 40 show that it is possible to achieve almost the LDH of strip 5 despite a lower copper content. This improvement of the LDH is obtained by reducing the quantity of Fe+Mn+Cr from 0.49% to 0.26%. This also makes it possible to reduce the yield strength in the T4 temper, which reduces the stamping forces and therefore facilitates the stamping operation.

Strip 1 has a thickness of 2.2 mm. The LDH of a strip of 5182 temper O at 2.2 mm being 30.5 mm and that of 5182 temper O at 1.2 mm being 28.0 mm, it can therefore be estimated that strip 2 has an LDH greater than 28.0 mm if it had been measured at 1.2 mm.

Graph 6 shows the impact on the compromise between the yield strength in the T4 temper and the yield strength after 2% elongation and then baking of the paints of 185° C. for 20 minutes ("bake hardening"). A lower Mg content reduces these yield strengths (strip 30 compared with strip 40). Increasing the pre-ageing temperature to 80° C. increases the yield strength after 2% elongation and then baking of the paints for 20 minutes at 185° C. This increase obtained on strip 41 compared with strip 40 makes it possible almost to obtain the yield strength after 2% elongation and then baking of the paints at 185° C. for 20 minutes of strip 30, which has a higher Mg content of 0.11%.

Strips 30, 31, 40, and 41 have low natural ageing, as shown by table 6 and FIG. 7, which makes it possible to ensure subsequent stamping of the strip despite the duration of storage. This graph also shows that a lower Mg content makes it possible to limit the yield strength in temper T4 during natural ageing, which is advantageous for guaranteeing stamping.

TABLE 6

| | Natural ageing (day) | | | | | | | |
|---|---|---|---|---|---|---|---|---|
| | 3 | 8 | 10 | 30 | 40 | 60 | 90 | 180 |
| Strip | R0.2 (MPa) in the T4 temper | | | | | | | |
| 1 | 130 | | | | 139 | | | |
| 2 | 140 | | | 142 | | 151 | | 158 |
| 30 | | 132 | | | 142 | | | |
| 31 | | | 139 | | 140 | | 144 | |
| 40 | | 122 | | | 129 | | | |
| 41 | | | 117 | | 122 | | 135 | |

FIG. 8 shows, in a graph of copper as a function of purity (sums of the Fe, Mn, and Cr contents), LDH results of strips 1, 30, 31, 40, 41, 5, 8, and 9. The straight line (Fe+Mn+Cr) ≤0.454*Cu separates the strips the LDH of which measured or estimated at a thickness of 1.2 mm is greater than 28.0 mm and the one the LDH of which is less than 28.0 mm.

The invention claimed is:

1. A method for manufacturing a coiled strip of aluminum alloy, comprising successively:

a. Casting a plate by semicontinuous vertical casting, b. Homogenizing the plate at a homogenization temperature optionally between 500° C. and 600° C., c. Transferring or forced cooling the plate thus homogenized directly to the hot roller, d. Hot-rolling the plate with a start temperature of hot rolling of a minimum of 350° C. and a maximum of 550° C. and an end temperature of hot rolling of a minimum of 250° C. and a maximum of 450° C., to obtain a strip with a final hot-rolling thickness of between 2.4 and 10 mm, e. Optionally cold rolling, f. Solution heat treatment and quenching, g. Pre-ageing obtained by coiling the strip at a pre-ageing temperature, the strip is not maintained at the pre-ageing temperature and then the coiled strip cools naturally to ambient temperature for a period of between 8 hours and 24 hours, h. Natural ageing, wherein the coiled strip has a composition, in wt %, Si: 1.00-1.50,
Fe: <=0.30,
Mn: <=0.30,
Mg: 0.20-0.44,
Cu: 0.80-1.50,
Ti: 0.03-0.15,
Cr: <=0.10,
Zn: <=0.10,
other elements: each <=0.05, together <=0.15,
remainder: Al.

2. The method according to claim 1, wherein the pre-ageing temperature is between 5° and 100° C.

3. A method for manufacturing an automobile part comprising successively:

a. Manufacturing the strip according to claim 1, b. Forming the strip c. Assembling as an automobile part with at least one other component made from 6xxx alloy, said other component optionally being manufactured from a sheet, d. Heat treatment.

4. A coiled strip of aluminum alloy in T4 temper having the composition, in wt %, Si: 1.00-1.50,
Fe: <=0.30,
Mn: <=0.30,
Mg: 0.20-0.44,
Cu: 0.80-1.50,
Ti: 0.03-0.15,
Cr: <=0.10,
Zn: <=0.10,
other elements: each <=0.05, together <=0.15,
remainder: Al.

5. The strip according to claim 4, wherein Si: 1.20-1.30.

6. The strip according to claim 4, wherein Mg: 0.25-0.35.

7. The strip according to claim 4, wherein Cu 0.80-0.90.

8. The strip according to claim 4, wherein Fe: 0.10-0.25.

9. The strip according to claim 4, wherein Ti >=0.05 and optionally <=0.15.

10. The strip according to claim 4, wherein the yield strength Rp0.2 in the T4 temper is greater than 100 MPa and/or less than 170 MPa and/or the LDH is greater than or equal to 28.0 mm, measured at a thickness of 1.2 mm.

11. The strip according to claim 4, wherein the strip has a yield strength Rp0.2 after elongation of 2% and then heat treatment of 20 minutes at 185° C. greater than or equal to 200 MPa and/or less than or equal to 310 MPa and/or the strip has a maximum intergranular corrosion pit depth after heat treatment of 20 minutes at 185° C. of less than 150 μm.

12. The strip according to claim 4, wherein Mn: 0.05-0.15.

13. The strip according to claim 4, comprising:

Si: 1.20-1.30,
Fe: 0.10-0.25,
Mn: 0.05-0.15,
Mg: 0.25-0.35,
Cu: 0.80-0.90,
Ti: 0.05-0.15,
Cr: <=0.10,
Zn: <=0.10,
other elements: each <=0.05, together <=0.15,
remainder: Al.

14. The strip according to claim 4, wherein (Fe+Mn+Cr) ≤0.454*Cu.

15. An automobile part, optionally an automobile door, obtained by the method according to claim 3.

16. The automobile part according to claim 15, wherein the strip has a yield strength R0.2 after 2% elongation and heat treatment of 20 minutes at 185° C. of a minimum of 200 MPa and/or a maximum of 310 MPa.

* * * * *